US009644483B2

(12) United States Patent
Subramaniyan et al.

(10) Patent No.: US 9,644,483 B2
(45) Date of Patent: May 9, 2017

(54) TURBOMACHINE BUCKET HAVING FLOW INTERRUPTER AND RELATED TURBOMACHINE

(71) Applicant: General Electric Company, Schenectady, NY (US)

(72) Inventors: Moorthi Subramaniyan, Bangalore (IN); Prabakaran Modachur Krishnan, Bangalore (IN)

(73) Assignee: General Electric Company, Schenectady, NY (US)

( * ) Notice: Subject to any disclaimer, the term of this patent is extended or adjusted under 35 U.S.C. 154(b) by 719 days.

(21) Appl. No.: 13/782,036

(22) Filed: Mar. 1, 2013

(65) Prior Publication Data

US 2014/0248139 A1 Sep. 4, 2014

(51) Int. Cl.

| | |
|---|---|
| ***F01D 11/00*** | (2006.01) |
| ***F01D 5/22*** | (2006.01) |
| ***F01D 11/02*** | (2006.01) |
| ***F01D 5/14*** | (2006.01) |
| ***F01D 11/08*** | (2006.01) |

(52) U.S. Cl.

CPC ..... *F01D 5/22* (2013.01); *F01D 5/143* (2013.01); *F01D 5/145* (2013.01); *F01D 5/146* (2013.01); *F01D 11/001* (2013.01); *F01D 11/006* (2013.01); *F01D 11/02* (2013.01); *F01D 11/08* (2013.01)

(58) Field of Classification Search

CPC ..... F01D 11/00; F01D 11/006; F01D 5/143; F01D 5/145; F01D 5/146; F01D 11/001; F01D 11/02

USPC ..... 416/224, 213 R, 235, 236 R, 237; 415/173.7, 171.1

See application file for complete search history.

(56) References Cited

U.S. PATENT DOCUMENTS

| | | | | | |
|---|---|---|---|---|---|
| 1,861,960 | A * | 6/1932 | Hanzlik | F01D 11/02 | 415/168.4 |
| 1,895,003 | A * | 1/1933 | Meyer | F01D 3/04 | 415/104 |
| 2,938,662 | A * | 5/1960 | Eckert | F04D 29/324 | 415/914 |
| 4,208,167 | A * | 6/1980 | Yasugahira | F01D 5/145 | 415/191 |
| 4,872,810 | A * | 10/1989 | Brown | F01D 5/22 | 416/145 |
| 5,211,533 | A | 5/1993 | Walker et al. | | |
| 5,244,345 | A * | 9/1993 | Curtis | F01D 11/008 | 416/193 A |
| 6,077,035 | A | 6/2000 | Walters et al. | | |

(Continued)

*Primary Examiner* — Charles Freay
*Assistant Examiner* — Christopher Bobish
(74) *Attorney, Agent, or Firm* — Ernest G. Cusick; Hoffman Warnick LLC

(57) ABSTRACT

Various embodiments include a turbomachine bucket having a flow interrupter, as well as related turbomachines. Various embodiments include a turbomachine bucket having: a base section sized to couple with a turbomachine rotor, the base section having a leading edge and a trailing edge opposing the leading edge; a blade section coupled to the base section and aligned to extend radially from the base section; a shroud coupled to the blade section and aligned to extend radially from the blade section; and a flow interrupter coupled to the leading edge of the base section.

18 Claims, 2 Drawing Sheets

(56) References Cited

U.S. PATENT DOCUMENTS 6,554,564 B1 * 4/2003 Lord ..... F01D 5/141 415/119
6,779,972 B2 8/2004 Farrell et al.
6,884,029 B2 * 4/2005 Beeck ..... F01D 5/145 415/191
7,044,710 B2 5/2006 Naik et al.
7,059,821 B2 * 6/2006 Farrell ..... F01D 5/225 415/1
7,114,339 B2 10/2006 Alvanos et al.
7,189,055 B2 3/2007 Marini et al.
7,244,104 B2 7/2007 Girgis et al.
7,445,433 B2 * 11/2008 Chivers ..... F01D 5/3061 416/193 A
7,549,835 B2 * 6/2009 Brillert ..... F04D 29/164 277/413
7,625,181 B2 * 12/2009 Matsuda ..... F01D 5/145 415/191
7,665,964 B2 * 2/2010 Taylor ..... F01D 5/143 415/194
8,105,037 B2 * 1/2012 Grover ..... F01D 5/143 416/179
8,419,356 B2 * 4/2013 Little ..... F01D 11/001 415/173.1
8,926,283 B2 * 1/2015 Lee ..... F01D 5/145 415/168.4
9,039,357 B2 * 5/2015 Lee ..... F01D 11/001 415/171.1
2006/0269399 A1 * 11/2006 Girgis ..... F01D 5/081 415/115
2008/0063529 A1 * 3/2008 Miller ..... F01D 5/147 416/193 A
2009/0280011 A1 * 11/2009 Tibbott ..... F01D 5/081 416/95
2010/0254806 A1 * 10/2010 Deodhar ..... F01D 11/001 415/173.7
2010/0322775 A1 * 12/2010 Surken ..... F01D 5/146 416/224
2013/0089430 A1 * 4/2013 Stein ..... F01D 11/001 416/235

* cited by examiner

TURBOMACHINE BUCKET HAVING FLOW INTERRUPTER AND RELATED TURBOMACHINE

FIELD OF THE INVENTION

The subject matter disclosed herein relates to power systems. More particularly, the subject matter relates to turbomachine systems.

BACKGROUND OF THE INVENTION

Conventional turbomachines (also referred to as turbines), such as steam turbines, generally include sets (or rows) of stationary airfoils, sometimes referred to as static nozzles, which direct the flow of a working fluid (e.g., steam) into a flow path occupied by corresponding sets (or rows) of rotatable buckets (or rotor blades). These rotatable buckets are coupled to a rotor shaft, which is substantially contained within the turbomachine diaphragm. The turbomachine diaphragm houses the sets of stationary airfoils, and provides a fluid inlet for the working fluid to enter the turbomachine. Each of the sets of rotatable buckets is held on a disc attached to the rotor body. The rotatable buckets and stationary airfoils radially overlap, and each corresponding set of stationary airfoils and rotatable buckets is generally referred to as a stage of the turbomachine. In order to prevent undesirable leakage flow of the working fluid between stages, shrouds and seals (also called packings) are used proximate the radial end of the stationary airfoils and rotatable buckets.

As the working fluid passes axially through the turbomachine away from its inlet, the pressure of the working fluid decreases. For example, the fluid pressure on the downstream side (axially downstream, farther from inlet) of a row of stationary airfoils is less than the fluid pressure on the upstream side (axially upstream) of that row of stationary airfoils. As a fluid medium, the working fluid naturally flows from the higher-pressure upstream side to the lower-pressure downstream side. This natural pull of the working fluid can cause leakage across the clearance between shrouds and packings used to seal respective stages of the turbomachine. The leakage flow can enter the downstream stage, in particular, the main flow path (upstream of the rotatable bucket), and randomly mix with the steam in the main flow path. This mixing can cause intrusion and mixing losses, which decrease the efficiency of the turbomachine.

BRIEF DESCRIPTION OF THE INVENTION

Various embodiments include a turbomachine bucket having a flow interrupter, as well as related turbomachines. Various embodiments include a turbomachine bucket having: a base section sized to couple with a turbomachine rotor, the base section having a leading edge and a trailing edge opposing the leading edge; a blade section coupled to the base section and aligned to extend radially from the base section; a shroud coupled to the blade section and aligned to extend radially from the blade section; and a flow interrupter coupled to the leading edge of the base section.

A first aspect of the invention includes a turbomachine bucket having: a base section sized to couple with a turbomachine rotor, the base section having a leading edge and a trailing edge opposing the leading edge; a blade section coupled to the base section and aligned to extend radially from the base section; a shroud coupled to the blade section and aligned to extend radially from the blade section; and a flow interrupter coupled to the leading edge of the base section.

A second aspect of the invention includes a steam turbomachine having: a diaphragm section including sets of nozzles extending radially inboard; a rotor section substantially contained within the diaphragm section, the rotor section including: a rotor body having a radially outer surface; and sets of buckets extending radially from the radially outer surface of the rotor body and axially interspersed between adjacent sets of the nozzles of the diaphragm section, wherein at least one bucket in the sets of buckets includes: a base section coupled to the rotor body, the base section having an axial facing leading edge and an axial facing trailing edge opposing the leading edge; a blade section coupled to the base section extending radially from the base section; a shroud coupled to the blade section and extending radially from the blade section; and a flow interrupter coupled to the leading edge of the base section.

A third aspect of the invention includes a turbomachine having: a diaphragm section; a rotor section substantially contained within the diaphragm section, the rotor section including: a rotor body having a radially outer surface; and sets of buckets extending radially from the radially outer surface of the rotor body, wherein at least one bucket in the sets of buckets includes: a base section coupled to the rotor body, the base section having an axial facing leading edge and an axial facing trailing edge opposing the leading edge; a blade section coupled to the base section extending radially from the base section; and a flow interrupter coupled to the leading edge of the base section.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
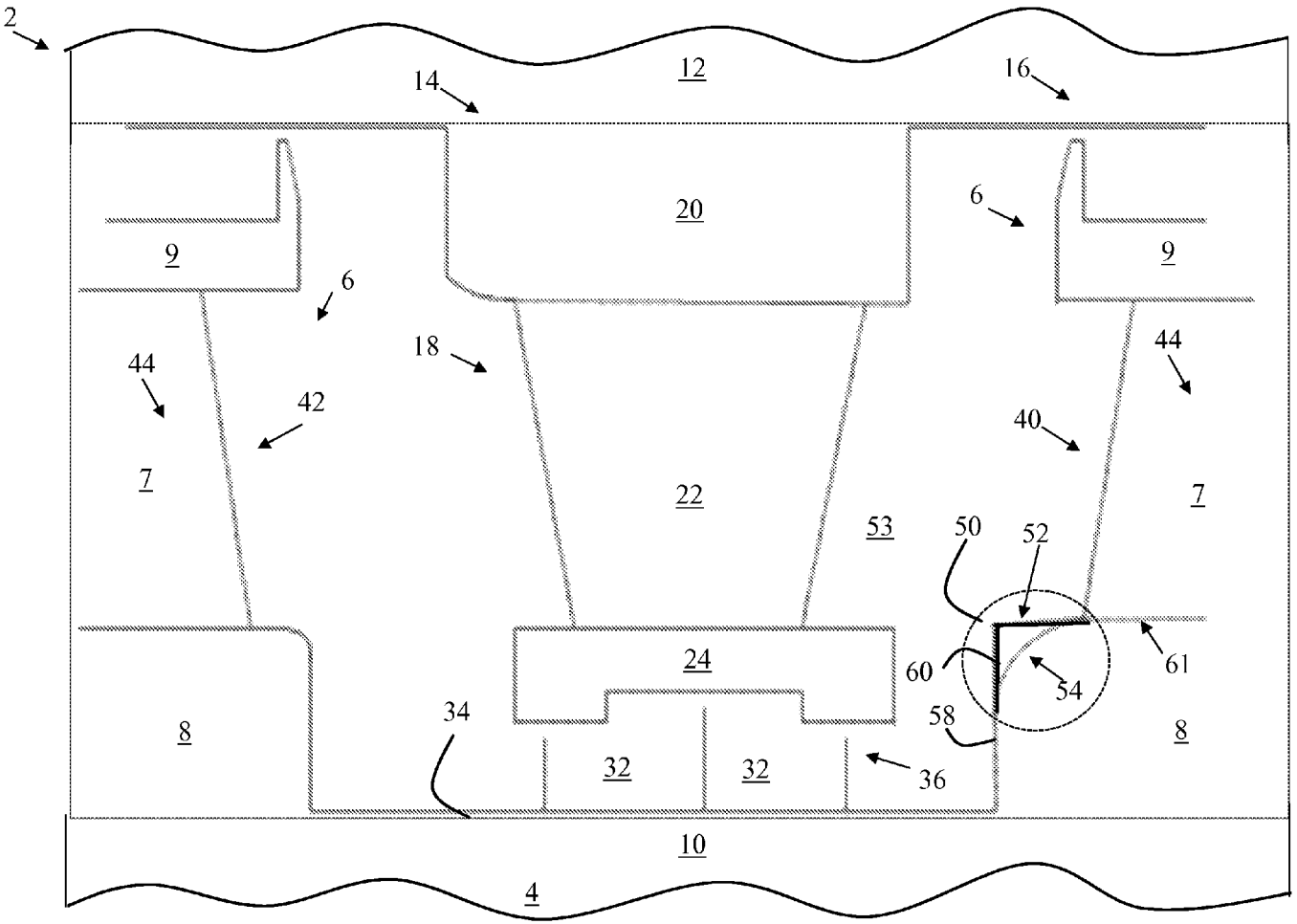
FIG. 1 shows a partial cross-sectional view of a turbomachine according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates to power systems. More particularly, the subject matter relates to turbomachine systems.

As described herein, as working fluid passes axially through the turbomachine away from its inlet, the pressure of the working fluid decreases. For example, the fluid pressure on the downstream side (axially downstream, farther from inlet) of a row of stationary airfoils is less than the fluid pressure on the upstream side (axially upstream) of that row of stationary airfoils. As a fluid medium, the working fluid naturally flows from the higher-pressure upstream side to the lower-pressure downstream side. This natural pull of the working fluid can cause leakage across the clearance between shrouds and packings used to seal respective stages of the turbomachine. The leakage flow can enter the downstream stage, in particular, the main flow path (upstream of the rotatable bucket), and randomly mix with the steam in the main flow path. This mixing can cause intrusion and mixing losses, which decrease the efficiency of the turbomachine.

In order to address issues with the conventional turbomachine, various embodiments of the invention include a flow interrupter that reduces intrusion losses due to random mixing of leakage flow with primary flow in a turbomachine. Various embodiments include one or more turbomachine rotatable bucket(s) that include a flow interrupter on an upstream-facing surface to prevent leakage flow between stages.

Various particular aspects of the invention include a turbomachine bucket having: a base section sized to couple with a turbomachine rotor, the base section having a leading edge and a trailing edge opposing the leading edge; a blade section coupled to the base section and aligned to extend radially from the base section; a shroud coupled to the blade section and aligned to extend radially from the blade section; and a flow interrupter coupled to the leading edge of the base section.

Various additional particular aspects of the invention include a steam turbomachine having: a diaphragm section including sets of nozzles extending radially inboard; a rotor section substantially contained within the diaphragm section, the rotor section including: a rotor body having a radially outer surface; and sets of buckets extending radially from the radially outer surface of the rotor body and axially interspersed between adjacent sets of the nozzles of the diaphragm section, wherein at least one bucket in the sets of buckets includes: a base section coupled to the rotor body, the base section having an axial facing leading edge and an axial facing trailing edge opposing the leading edge; a blade section coupled to the base section extending radially from the base section; a shroud coupled to the blade section and extending radially from the blade section; and a flow interrupter coupled to the leading edge of the base section.

Various other particular aspects of the invention include a turbomachine having: a diaphragm section; a rotor section substantially contained within the diaphragm section, the rotor section including: a rotor body having a radially outer surface; and sets of buckets extending radially from the radially outer surface of the rotor body, wherein at least one bucket in the sets of buckets includes: a base section coupled to the rotor body, the base section having an axial facing leading edge and an axial facing trailing edge opposing the leading edge; a blade section coupled to the base section extending radially from the base section; and a flow interrupter coupled to the leading edge of the base section.

As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference which surrounds axis A but does not intersect the axis A at any location.

Turning to FIG. 1, a schematic cross-sectional view of a portion of a turbomachine (e.g., a steam turbomachine, also referred to as a steam turbine) 2 is shown according to various embodiments of the invention. As shown, the turbomachine 2 can include a rotor section 4 with a set of axially disposed rotor buckets 6. As is known in the art, the rotor buckets 6 (also referred to as rotor blades) can rotate with the rotor section 4 in response to fluid flow within the turbomachine 2. The rotor buckets 6 can include a base section 8 (also referred to as a dovetail section) coupled to the body 10 of the rotor section 4. The buckets 6 can also include a blade section 7 extending radially from the base section 8 toward a diaphragm section 12 of the turbomachine. At a radial end of the bucket 6 is a shroud 9. As noted, the turbomachine 2 can also include a diaphragm section 12 at least partially surrounding the rotor section 4. The diaphragm section 12 can include a set of nozzles 14 positioned between adjacent sets 16 of axially disposed rotor blades (buckets) 6. As described herein, each pairing of a set of nozzles 14 and set of blades (buckets) 16 is referred to as a "stage" of the turbomachine. As is known in the art, during operation of the turbomachine 2, working fluid (e.g., steam) enters a space between the diaphragm (shown as diaphragm section 12) and the rotor (shown as rotor section 4) (via an inlet, not shown), and is guided across the rotor blades (buckets) 6 (blade sections 7) by the nozzles 14 (in particular, the blade sections 22), which causes the rotor section 4 to rotate within the diaphragm section 12.

The sets of nozzles 14 in the diaphragm section 12 includes at least one nozzle 18 having a base section 20 coupled to the diaphragm section 12. The nozzle 18 further includes a blade (nozzle blade) 22 coupled to the base section 20. The nozzle 18 further includes a radial tip section (also referred to as a shroud) 24 coupled to a radial end of the blade 22. Also shown is a packing 32, which can extend from a surface 34 of the rotor body 10 or from the radially inner surface of the radial tip section 24. The shroud 24 and packing 32 form a seal (e.g., an axial seal) 36 between adjacent stages of the turbomachine 2.

As shown, the turbomachine rotor bucket 6 can include a leading edge 40 and a trailing edge 42 opposing the leading edge 40. The leading edge 40 faces axially upstream (toward the inlet of the turbomachine, against the axial flow of the working fluid), while the trailing edge 42 faces axially downstream from the rotor bucket 6. As shown, the turbomachine rotor bucket 6 includes a pressure side 44 and a suction side 46 (not shown, obstructed in this view). The pressure side 44 is the concave surface of the bucket 6 that is designed to intercept the flow of the working fluid, while the suction side 46 opposes the pressure side 44 of the bucket 6.

In contrast to conventional turbomachine rotor buckets, the rotor bucket 6 includes a flow interrupter 50 (highlighted by dashed circle) coupled to the leading edge 40 of the base section 8 that can act to interrupt the flow of the working fluid that leaks across the seal 36 between stages of the turbomachine 2. That is, the flow interrupter 50 can interrupt the leakage flow of fluid from the seal 36 to the primary fluid flow region 53 between the nozzle 18 and turbomachine bucket 6.

In various embodiments, the flow interrupter 50 includes a flange 52 extending at least partially axially from the base section 8 of the bucket 6. In some cases, the leading edge 40 of the base section 8 includes a substantially chamfered surface 54 proximate a joint 61 between the base section 8 and the blade section 7. The substantially chamfered surface 54 can be a substantially rounded chamfer surface in some embodiments. In some cases, the flow interrupter 50 extends from the chamfered surface 54. The base section 8 can further include a substantially planar surface 58 that is continuous with the substantially chamfered surface 54. In these embodiments, the flow interrupter 50 includes a face 60 that is coplanar with the substantially planar surface 58 of the base section 8.

Figure 2:
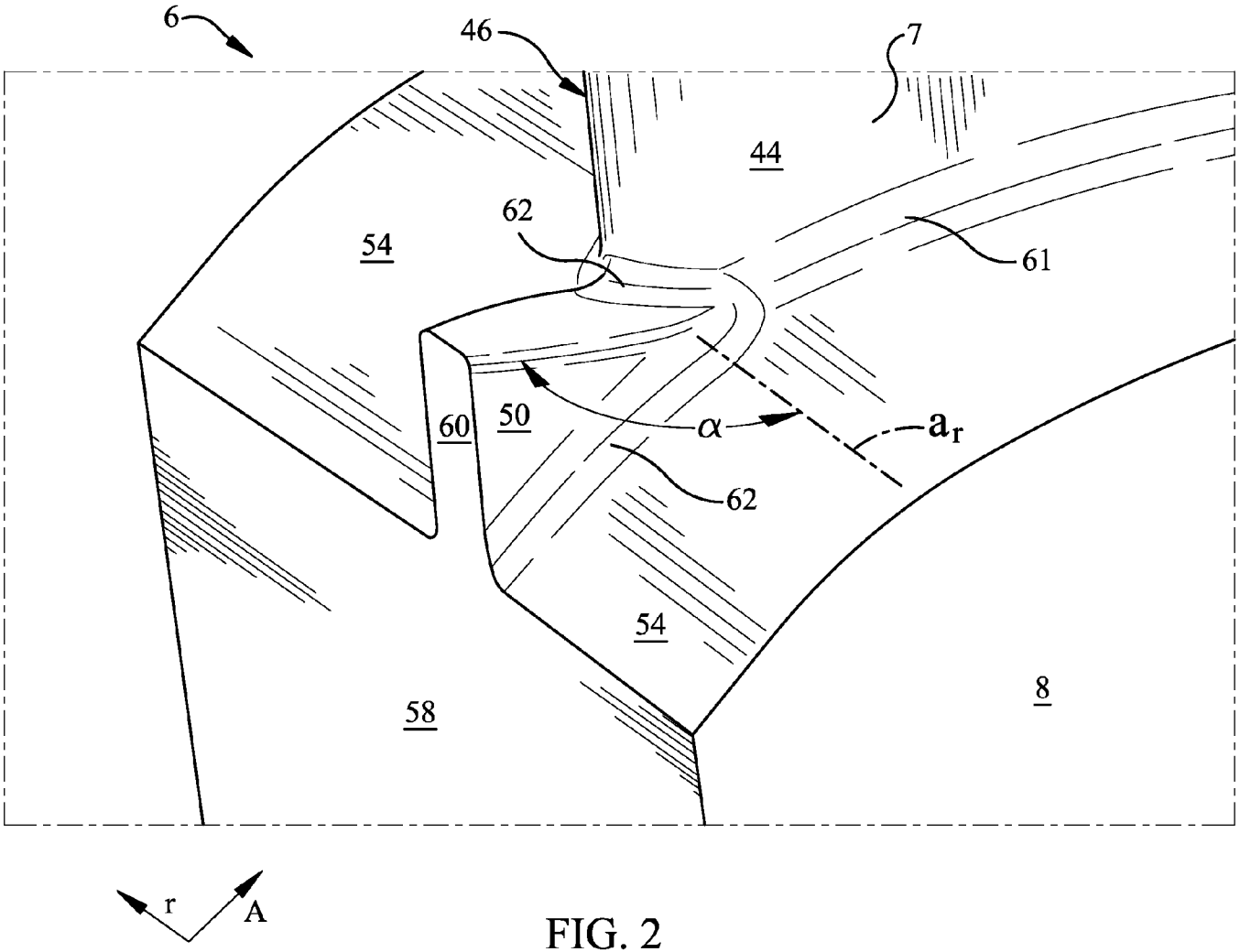
FIG. 2 shows a close-up partial three-dimensional perspective view of a turbomachine bucket according to various embodiments of the invention.

Turning to FIG. 2, a three-dimensional close-up perspective view of a turbomachine bucket 6 is shown according to various embodiments. In this view, the flow interrupter 50 is shown having a substantially equal width (as measured across the leading edge, e.g., circumferentially across the base section 8) as the blade section 7 proximate the joint 61 between the base section 8 and the blade section 7. In some embodiments, the flow interrupter 50 is coupled to the leading edge 40 of the base section 8 by a weld 62. More particularly, the flow interrupter 50 is attached to the chamfered surface 54 of the base section 8 by the weld 62. In various embodiments, the weld 62 can include a TIG weld, MIG weld, etc. In alternate embodiments, the weld 62 is replaced with a brazing joint (not shown).

In various embodiments, the flow interrupter 50 is angled with respect to a reference axis $a_r$ (parallel with the radial axis r). In some cases, the flow interrupter 50 is aligned at an angle ($\alpha$) that is approximately perpendicular (90 degrees) with the reference axis ($a_r$), however, in other cases, the angle ($\alpha$) between the flow interrupter 50 and the reference axis ($a_r$) (parallel with the radial axis r) is equal to approximately 45 degrees and 225 degrees.

With reference to FIGS. 1-2, the flow interrupter 50 can affect the pressure differential between the pressure side 44 and the suction side 46 of the turbomachine bucket 6 during operation of the turbomachine 2. For example, in some cases, the flow interrupter 50 can modify a pressure differential of the steam between the pressure side 44 and suction side 46 of the turbomachine bucket 6 when compared with a conventional turbomachine bucket.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A turbomachine bucket comprising:

a base section sized to couple with a turbomachine rotor, the base section having a leading edge and a trailing edge opposing the leading edge, wherein the leading edge of the base section includes a planar surface;

a blade section coupled to the base section and aligned to extend radially from the base section;

a shroud coupled to the blade section and aligned to extend radially from the blade section; and a single flow interrupter coupled to the leading edge of the base section, wherein the single flow interrupter includes a planar face extending from the planar surface of the leading edge of the base section such that the entire planar face of the flow interrupter is coplanar to the planar surface of the leading edge of the base section, and wherein the single flow interrupter has a substantially equal width as the blade section proximate a joint between the flow interrupter and the blade section, the width of the blade section and the width of the flow interrupter being measured along the leading edge of the base section.

2. The turbomachine bucket of claim 1, wherein the flow interrupter includes a flange extending at least partially axially from the leading edge of the base section to a weld joint between the flow interrupter and the blade section.

3. The turbomachine bucket of claim 1, wherein the leading edge of the base section includes a substantially chamfered surface proximate a joint between the base section and the blade section, and wherein the flow interrupter extends from the chamfered surface.

4. The turbomachine bucket of claim 3, wherein the planar surface of the leading edge of the base section is continuous with the substantially chamfered surface.

5. The turbomachine bucket of claim 3, wherein the substantially chamfered surface is substantially rounded.

6. The turbomachine bucket of claim 1, wherein the flow interrupter is coupled to the leading edge of the base section by a weld.

7. A steam turbomachine comprising:

a diaphragm section including sets of nozzles extending radially inboard;

a rotor section substantially contained within the diaphragm section, the rotor section including:

a rotor body having a radially outer surface; and sets of buckets extending radially from the radially outer surface of the rotor body and axially interspersed between adjacent sets of the nozzles of the diaphragm section, wherein at least one bucket in the sets of buckets includes:

a base section coupled to the rotor body, the base section having an axial facing leading edge and an axial facing trailing edge opposing the leading edge, wherein the axial facing leading edge of the base section includes a planar surface;

a blade section coupled to the base section extending radially from the base section;

a shroud coupled to the blade section and extending radially from the blade section; and a flow interrupter coupled to the leading edge of the base section, wherein the flow interrupter extends from the leading edge of the base section to a weld joint between the blade section and the flow interrupter, and wherein the flow interrupter includes a planar face extending from the planar surface of the leading edge of the base section such that the entire planar face of the flow interrupter is coplanar to the planar surface of the leading edge of the base section, and wherein the flow interrupter has a substantially equal width as the blade section proximate the weld joint between the flow interrupter and the blade section, the width of the blade section and the width of the flow interrupter being measured along the leading edge of the base section.

8. The steam turbomachine of claim 7, wherein the flow interrupter prevents leakage flow of a working fluid proximate a junction of the base section and the blade section.

9. The steam turbomachine of claim 7, wherein the at least one bucket includes a pressure side extending between the leading edge and the trailing edge, and a suction side opposing the pressure side and extending between the leading edge and the trailing edge, wherein the flow interrupter affects a pressure differential between the pressure side and the suction side during operation of the steam turbomachine.

10. The steam turbomachine of claim 7, wherein the flow interrupter includes a flange extending at least partially axially from the base section.

11. The steam turbomachine of claim 7, wherein the leading edge of the base section includes a substantially chamfered surface proximate a joint between the base section and the blade section, and wherein the flow interrupter extends from the chamfered surface.

12. The steam turbomachine of claim 11, wherein the planar surface of the leading edge of the base section is continuous with the substantially chamfered surface.

13. The steam turbomachine of claim 11, wherein the substantially chamfered surface is substantially rounded.

14. The steam turbomachine of claim 7, wherein the flow interrupter is coupled to the leading edge of the base section by a weld.

15. A turbomachine comprising:

a diaphragm section;

a rotor section substantially contained within the diaphragm section, the rotor section including:

a rotor body having a radially outer surface; and sets of buckets extending radially from the radially outer surface of the rotor body, wherein at least one bucket in the sets of buckets includes:

a base section coupled to the rotor body, the base section having an axial facing leading edge and an axial facing trailing edge opposing the leading edge, wherein the axial facing leading edge of the base section includes a planar surface;

a blade section coupled to the base section extending radially from the base section; and a flow interrupter coupled to the leading edge of the base section, wherein the flow interrupter has a width substantially equal to a width of the blade section proximate a joint between the flow interrupter and the blade section, and wherein the flow interrupter includes a planar face extending from the planar surface of the leading edge of the base section such that the entire planar face of the flow interrupter is coplanar to the planar surface of the leading edge of the base section.

16. The turbomachine of claim 15, wherein the flow interrupter is angled with respect to a radial axis of the rotor section at an angle between approximately 45 degrees and approximately 225 degrees.

17. The turbomachine of claim 15, wherein the at least one bucket includes a pressure side extending between the leading edge and the trailing edge, and a suction side opposing the pressure side and extending between the leading edge and the trailing edge, wherein the flow interrupter affects a pressure differential between the pressure side and the suction side during operation of the steam turbomachine.

18. The turbomachine of claim 15, wherein the flow interrupter is a single flow interrupter and wherein the flow interrupter extends from the leading edge of the base section to a weld joint between the blade section and the flow interrupter.

* * * * *